US006708349B2

(12) United States Patent
Semeia

(10) Patent No.: US 6,708,349 B2
(45) Date of Patent: Mar. 23, 2004

(54) DIVING AND SWIMMING MASK

(75) Inventor: Roberto Semeia, Lavagna (IT)

(73) Assignee: Scubapro Europe S.r.l., Casarza Ligure (IT)

( * ) Notice: Subject to any disclaimer, the term of this patent is extended or adjusted under 35 U.S.C. 154(b) by 0 days.

(21) Appl. No.: 10/252,846

(22) Filed: Sep. 24, 2002

(65) Prior Publication Data

US 2003/0056280 A1 Mar. 27, 2003

(51) Int. Cl.[7] ..... A61F 9/02
(52) U.S. Cl. ..... 2/426; 2/428
(58) Field of Search ..... 2/428, 429, 430, 2/431, 432, 438, 440, 442, 450, 452, 451, 453, 426; 351/43

(56) References Cited

U.S. PATENT DOCUMENTS 3,944,345 A * 3/1976 Decorato ..... 351/43
5,420,649 A 5/1995 Lewis
5,611,644 A * 3/1997 Lutz ..... 405/186
5,657,493 A * 8/1997 Ferrero et al. ..... 2/428
6,131,246 A * 10/2000 Paulson et al. ..... 24/265 BC
6,272,693 B1 * 8/2001 Godoy ..... 2/430
6,321,390 B1 * 11/2001 Chiang ..... 2/428
6,477,717 B1 * 11/2002 Winefordner et al. ..... 2/428

FOREIGN PATENT DOCUMENTS

FR 964 905 8/1950
FR 2.196.628 * 8/1972 ..... B63C/11/00

* cited by examiner

*Primary Examiner*—Gary L. Welch
(74) *Attorney, Agent, or Firm*—James Creighton Wray; Meera P. Narasimhan

(57) ABSTRACT

A diving and swimming mask, comprising a mask body made of a soft material which has at least one front opening around the eye region, which opening is closed by a transparent member, particularly a lens and there being provided, at each lateral side of the mask, attachment points for attaching an end of a strap and/or a buckle element for engagement of an end of a strap for fastening the mask against the user's face. According to the invention, when worn by the user the transparent member is positioned inclined or may be positioned inclined against the face of the user at the lower edge of the said transparent member, i.e. at the edge nearest to the user's mouth so that the upper edge of the transparent element is nearer to the user's face at the said lower edge, than at the opposite upper edge of the said transparent element.

44 Claims, 11 Drawing Sheets

DIVING AND SWIMMING MASK

This application claims the benefit of Italian Application No. SV2001A000031 filed Sep. 24, 2001.

BACKGROUND OF THE INVENTION

The invention relates to a diving and swimming mask, comprising a mask body made of a soft material which has at least one front opening around the eye region, which opening is closed by a transparent member, particularly a lens and there being provided, at each lateral side of the mask, means for attaching an end of a strap and/or a buckle element for engagement of an end of a strap for fastening the mask against the user's face.

As is known, scuba diving masks typically have a fastening strap, whose ends are generally attached in a median area of each mask side, particularly in a median area of each vertical side edge of a frame which is designed to support and hold the lens against the mask body. When the mask is worn, the strap is passed behind the nape of the user and appropriately positioned thanks to the shape adjustment allowed by the intrinsic deformability and elasticity of the material wherefrom the strap is made. Although this arrangement may accomplish its purpose, the strap positioning adjustment and customization potential is rather limited, because it is substantially only due to the elastic deformation of the strap. Further, as will be apparent hereafter, the arrangement that consists in providing the strap end attachments in a vertically intermediate position of the mask causes the mask body to be substantially homogeneously compressed against the user's face, and this is not an optimal condition.

SUMMARY OF THE INVENTION

Therefore, the object of this invention is to improve, by simple and inexpensive means, the system for attaching the fastening straps to diving masks, by improving the tight fit against the user's face, allowing more extensive and effective adjustments and customizations as compared with current possibilities, and increasing the comfort and safety level as compared with prior art masks.

The invention achieves the above purposes by providing a mask as described hereinbefore, in which when worn by the user the transparent member is positioned inclined or may be positioned inclined against the face of the user at the lower edge of the said transparent member, i.e. at the edge nearest to the user's mouth so that the upper edge of the transparent element is nearer to the user's face at the said lower edge, than at the opposite upper edge of the said transparent element.

According to one embodiment of the invention means are provided for displacing the transparent element in the inclined position.

The said means for displacing the transparent element in the inclined position are formed by the means for attaching the strap and/or the buckle element which are placed in a preferably downward staggered position, so that they are eccentric to and/or at least below the interpupillary line, with reference to the vertical extension of each side of the mask, and with reference to the mask being worn by a standing user.

In practice, the attachment point for each strap end is substantially located at the side of the zygomatic bone. This arrangement advantageously enhances the strap pulling effect on the lower portion of the mask body, thereby causing the lower portion of the lens to .be drawn closer to the user's face, and to considerably broaden the visual range of the user in the downward direction, whereas prior art masks have a generally restricted downward visual range. This arrangement may allow, for instance, better visibility of the equipment or devices, which are generally in contact with the chest and/or belly of the diver, thereby increasing the diving safety factor. It shall be further noted that the fit of the soft mask body against the user's face is generally more troublesome in the lower portion thereof which adheres against an anatomically complex region, as compared with the portion in contact with the forehead, which generally has a homogeneous and even curved profile. Particularly, for users wearing a beard or whiskers or having some unfavorable anatomic conformation, an enhanced pulling effect on the lower portion of the mask body may help to improve adhesion of the sealing lip thereof against the corresponding anatomic region below and at the sides of the nose, i.e. the upper lip, according to the appropriate anatomic definition, thereby ensuring a better sealing effect. Moreover, the compression of the mask body may help to achieve an advantageous reduction of the air volume inside the mask.

These means for attaching the strap and/or the buckle element may be positioned on each of the two vertical side edges of the mask and/or on means designed to hold the lens against the soft mask body.

According to an advantageous improvement, these means for attaching the strap and/or the buckle element may be secured to the mask in such a manner as to allow displacement thereof in at least one direction, particularly in the vertical direction, to change the vertical stagger thereof, and allow a finer adjustment of the strap attachment point and eventually a more accurate customization.

In accordance with an additional improvement, the means for attaching the strap and/or the buckle element may be secured to the mask in such a manner as to be able to swing about an axis that is horizontal and/or perpendicular to the extension of the strap in the attachment zone.

The lens holding means may consist of at least one rigid frame which extends all along the peripheral edge of the at least one lens, thereby compressing it in a water-tight manner against the edge of the at least one front opening of the soft mask body.

Means may be provided for attaching each end of the strap or each buckle element to their respective side edges of the frame, which means may be permanent or removable.

Means may be also provided which allow oscillation with respect to the side edge whereto each end of the strap or each buckle element are attached, particularly about an axis which is substantially horizontal and perpendicular to the side edge of the holding frame, and to the extension of the strap in that zone.

Means may be also provided for adjusting the height of the attachment point for each end of the strap or each buckle element on their respective side edges of the frame.

In accordance with a preferred embodiment of the invention, which will be described in greater detail in the description of the drawings, the mask of this invention may include at least one backward extension of each vertical side edge of the frame for holding the lens against the mask body, on each vertical side edge, with reference to the observation direction of the mask user. Each of these backward extensions may advantageously form a housing for a buckle element, which buckle may include strap locking means of the stationary or tilting type, which use a manual control to automatically release the strap in the loosing and/or tightening direction.

Each of these backward extensions may be placed in a downward staggered position with reference to the vertical extension of the side edge of the lens holding frame, and with reference to the mask as worn by a standing user.

One or both buckle elements may be secured in a non removable manner on their respective backward extensions.

According to a highly advantageously improvement, at least one, but preferably both buckle elements may be removably coupled to their respective backward extensions, particularly by snap-lock means. Said snap-lock means and the buckles may be made in any manner known to be suitable for the accomplishment of their functions.

According to a preferred embodiment, each backward extension of the frame may be composed of two substantially vertical and parallel walls, extending backwards from each side edge of the frame, in such a manner as to form a recess or a pocket open at the rear, which acts as a snap seat for a buckle plate or a part thereof, the thickness of said plate or part thereof being slightly smaller than the distance between the two walls.

The outer and/or the inner wall of said snap seat may have one or more snap engagement holes or apertures for a corresponding number of coupling/uncoupling members having a complementary shape and being disposed on the outer and/or inner surface of the buckle plate.

Particularly, the outer wall of the snap seat may have a substantially central hole or aperture for snap engagement/disengagement of a corresponding coupling/uncoupling member which is placed substantially at the center of the outer face of the buckle plate.

This coupling/uncoupling member may be placed on an end of a resilient tab, formed by notching the material of the buckle plate, and may be formed by a widened portion of said end on the side turned toward the outside of the mask This coupling/uncoupling member may have an outer surface approximately as large, and particularly slightly larger than the surface of a finger end, in such a manner that is may form a pushbutton, to be easily accessible from the outside for quick coupling/uncoupling of the buckle.

In accordance with an additional improvement, the buckle elements may be oriented in such a manner that the longitudinal axis of the strap engaged therein is inclined with respect to the direction substantially horizontal and/or perpendicular to the transparent member, and anyway in such a manner as to prevent any interference of the strap with the ear region.

As an additional improvement, each buckle element may be fastened to its respective backward extension of the frame in such a manner as to be able to saving, particularly about an axis which is substantially horizontal and perpendicular to the side edge of the frame or to the extension of the strap in that zone.

Advantageously, the coupling/uncoupling button, as well as the engagement hole therefore, may have a correspondingly circular shape, to simultaneously act as snap-lock means for the buckle plate in its snap seat, and as means for allowing the buckle element to swing, i.e. as a pivot or hub.

Thanks to the above arrangements, a considerable advantage may be obtained, i.e. a quick and safe strap coupling/uncoupling action, and especially a more accurate adjustment of the strap position on the head, and an optimized positioning of the mask on the users face. In fact, by swinging the buckle, the strap may be positioned particularly in an upwardly inclined position, still with reference to a standing user of the mask, to cause it to adhere against the upper portion of the nape, thereby preventing any interference with the ear region, and increasing the comfort level of the mask. A considerable advantage may be also provided in terms of functionality, since the oscillation of the mask body on the strap ends provides a better fit of the soft mask body on any face anatomy, and especially facilitates the operation of emptying the mask of infiltrated water, which operation, as is known, requires the lower portion of the mask body to be lifted forwards.

The front end portion of the buckle plate may have a circular edge, coaxial to the central pushbutton, having the shape of an arc of a circle, whereas the snap-lock recess formed by the two walls may have, near said end, an accordingly circular profile, coaxial to the central engagement hole, so that it may form a guide wall for the swinging buckle plate.

According to an improvement, means for limiting the swinging stroke of the buckle element may be provided, particularly such that the two branches of the strap may be oriented from a substantially horizontal position to an upwardly inclined position, particularly through about 45 degrees.

These means may consist of two teeth, each extending transversely from each of two opposite longitudinal edges of the buckle plate inwards and/or out of the mask, which teeth abut in both directions at the end of the swinging stroke against the rear edge of the inner wall and/or of the outer wall of the snap seat for the buckle plate.

The outer wall of the snap seat for each buckle plate may have two or more holes, having the same diameter, for the pushbutton to snap therein, so that the attachment point for the buckle element may be changed.

Advantageously, these holes may be arranged along a substantially vertical axis, to allow height adjustment of the attachment point for the buckle plate and particularly the adjustment of the downward stagger thereof.

In a different embodiment, the outer wall of the snap seat may have an elongated slot for engagement of the pushbutton, which extends in a substantially vertical direction, here again to allow height adjustment of the attachment point for the buckle plate.

Particularly, this slot may be composed of a succession of partly overlapping holes, i.e. such that the difference between the centers of two adjacent holes is smaller than the diameter thereof.

According to an improvement, the inner face of the inner wall and/or of the outer wall, which define the snap seat for the buckle plate may have grooves for sliding engagement, substantially in the axial direction of the strap, of corresponding tabs or ribs arranged on the inner and/or outer faces of the buckle plate, or vice versa, in such a position as to form buckle plate guides for holding the various height positions of this plate in addition to the holes and/or to the slot for snap engagement of the pushbutton of the buckle element.

Since the above configuration allows height adjustment of the buckle, but no oscillation thereof, an additional improvement might provide that the buckle plate, whose outward face includes the pushbutton, may be mounted in such a manner as to be able to rotate about a pivot placed on the opposite inner face, on another element having tabs or ribs for axial slide engagement of the strap, in corresponding grooves formed on the face that defines the snap seat internally and/or externally.

It is worth noting that the pivot and the pushbutton shall be coaxial to each other, to allow the buckle element to swing to a condition in which its plate is engaged in the snap seat.

In a particular embodiment, which will be disclosed in greater detail in the description of the drawings, the buckle element may include locking means which cooperate with the strap, particularly a swivel frame, fitted in a plate member which forms the body of the separate buckle.

The advantages of the invention are self-evident from the above description and have been widely explained above. It is apparent that all the above characteristics as a whole allow to considerably increase both the comfort and the safety level of scuba diving masks as compared with prior art masks.

In combination with any previous arrangements, the means for attaching the strap to the mask may be downwardly staggered to such an extent as to partly project beyond the lower edge of the corresponding lateral side of the mask. In this case, said attachment means are secured over at least a portion of their extension, to a lower extension of said side.

In the case of the illustrated embodiment, the extension for snap coupling or housing the buckle swivel not only extends in the backward direction with respect to the transparent element, but also extends downwards beyond the lower edge of the frame for holding the transparent element against the mask body.

Further characteristics and improvements will form the subject of the dependent claims.

The characteristics of the invention and the advantages derived therefrom Will be more apparent from the following detailed description of the annexed drawings.

DETAILED DESCRIPTION OF THE PREFERRED EMBODIMENTS

Figure 1:
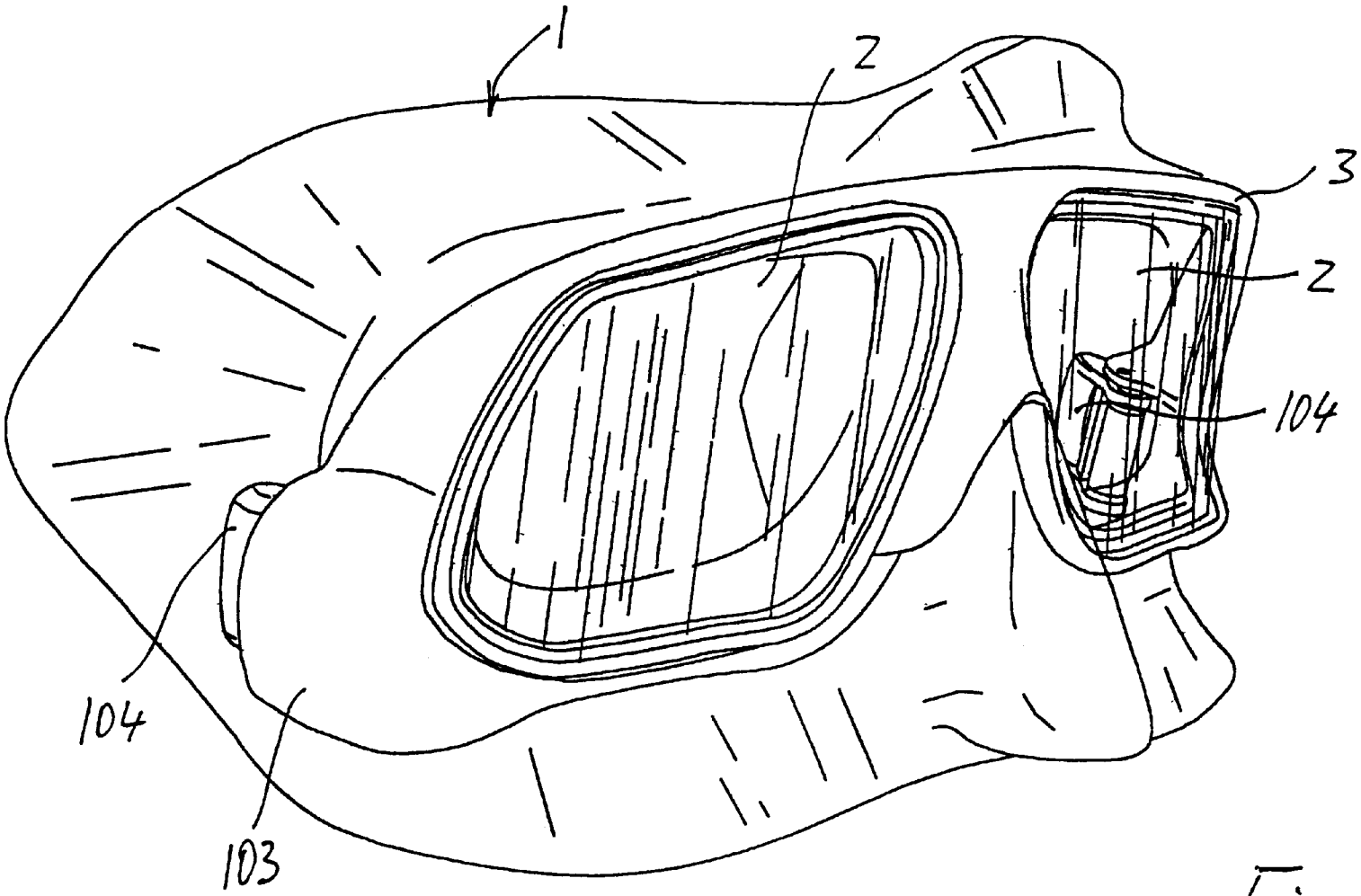
FIG. 1 is a perspective view of a first embodiment of the mask according to the invention.

Referring to FIG. 1, a dual lens diving mask of the invention is shown, but the following considerations also apply to any other type of mask, particular those having a single lens extending over both eyes. The mask has a mask body 1 made of a soft and comfortable material, particularly rubber or the like. This body 1 has a pair of front apertures, each around the region of an eye, and each closed by a transparent element, i.e. generally a lens 2. The lenses 2 are held along the edges of their respective front openings of the mask body 1 by a sealing and holding frame 5, which is made of a rigid and light material, particularly plastic. Any well-known arrangement may be provided to hold and seal the lenses 2 against the front openings of the mask body 1, e.g. the use of two rigid frames, to be welded and/or glued together, the peripheral edge of each front opening and the peripheral edge of each lens 2 being interposed therebetween.

The frame 3 has, at each vertical side edge, a vertical wall 103 which extends backwards, and forms a snap seat for a buckle designed to tension and lock a strap for pressing the mask against the user's face. As is apparent from FIG. 1, said vertical wall 103 only extends in the lower portion of the side edge of the frame 3, so that the buckle attachment point is downwardly staggered with respect to the median zone of said side edge, which zone, in prior art masks, corresponds to the attachment zone for the strap and/or the buckle. It shall be noted that the guiding principle of the invention, i.e. the downward stagger of the attachment point for the strap and/or the buckle is designed to apply to any other type of mask. For example, the vertical wall 103 whereby the frame 3 extends backwards may be omitted, and similarly one or both buckles may be also omitted, so that the simplest embodiment of the mask according to the invention provides a frame 3 with no backward extension, and in which the ends of the straps are directly fastened by appropriate means, on the lower portion of each side edge of the frame 3. FIG. 1 clearly shows that the downward staggered position of the attachment points for the strap ends involves an enhanced pulling effect on the lower portion of the mask body 1 with all the above described advantages.

Still with reference to FIG. 1, the mask is used in combination with two buckles, each including strap locking means, i.e. a swivel frame 104, which provides an automatic release of the strap in the loosening and/or stretching direction. In this case, the inner face of the wall 103 acts as a stationary surface for compressing and supporting the strap and for stopping the swivel member 104, whereby it may be considered, at least in terms of functionality, as a part of the buckle. Any other type of buckle may be obviously also provided, e.g. one of the types which include fixed strap locking means, or of the type in which the strap locking means may be disengaged by manual pressure thereon against the action of elastic means, such as springs or the like.

Still with reference to FIG. 1, it shall be noted that the downward staggering distance is such that the strap attachment point projects downwards at least partly beyond the lower edge of the frame.

Figure 2:
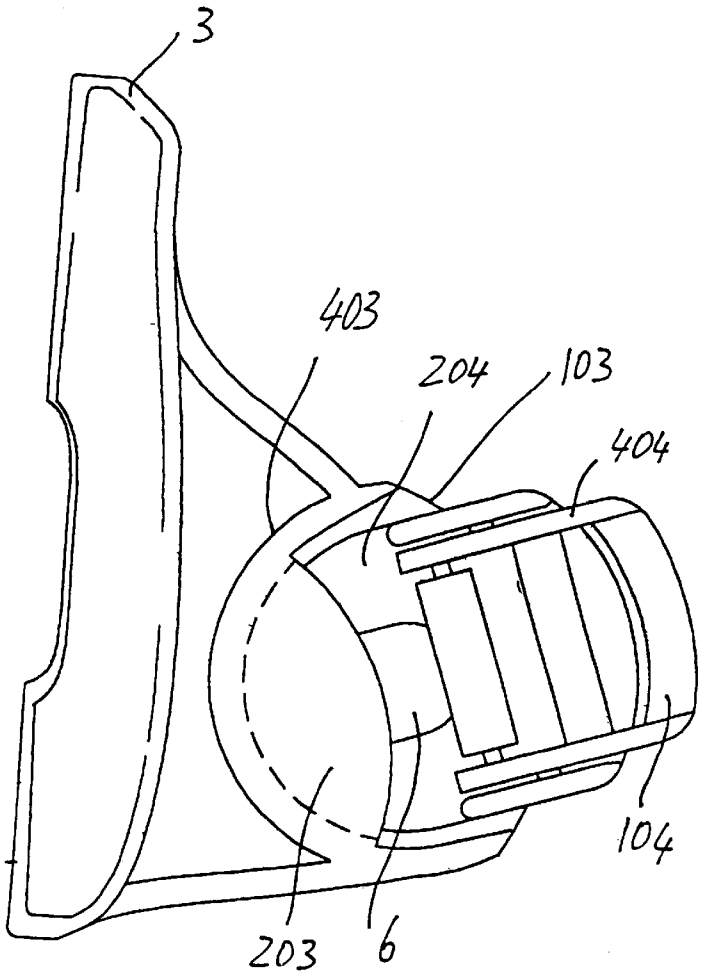
FIG. 2 is a sectional view as seen from a plane perpendicular to the lens (sagittal plane) of the holding frame and a front view from within the mask of the buckle attachment zone, the buckle being inserted in its housing, with reference to a second embodiment of the mask.

Referring now to FIG. 2, an improvement of the invention is shown wherein the buckle, besides being secured in a downwardly staggered position, is provided with snap-lock means, which allow a quick and safe coupling/uncoupling action, as well as an oscillation thereof about an axis which is substantially horizontal and perpendicular to the extension of the strap in the attachment area In this embodiment, two substantially vertical walls 103, 203 are provided, which extend backwards from the lower portion of each side edge of the frame 3, in such a manner as to form a recess or a pocket open at the rear which acts as a snap seat for a buckle plate 204. Once more, this embodiment is shown in combination with a buckle having a swivel member 104 for automatically coupling/uncoupling the strap, and in which the inner wall of the plate 204 acts as an abutment and compression wall for the strap, whereby it can be considered as a part of the buckle. Obviously, any other type of buckle, possibly simpler, may be provided, provided it has coupling/uncoupling/swinging means according to the invention, as described below.

Still referring to FIG. 2, the front portion of the buckle plate 204 has a thickness that is slightly smaller than the distance between the two walls 103, 203, which define the snap seat, so that it can be inserted in the recess formed by the two walls 103, 203. The outer wall 103 has a circular and substantially central hole 5 for snap engagement/disengagement of a corresponding coupling/uncoupling member 6 which is placed substantially at the center of the outer face of the front of the buckle plate. Said pushbutton 6 has at its end a resilient tab 304, formed by notching the material of the buckle plate 204, and is formed by a widened portion of said end on the side turned toward the outer extension wall 103. Preferably, said coupling/uncoupling button 6 has an outer surface which is slightly smaller than the surface of a finger end, in such a manner that it may be easily accessible from the outside and that it may be pushed by a user for quick unsnap or release of the buckle element.

Since both the button 6 and the hole 5 have corresponding circular shapes, they act as a swinging fulcrum for the buckle. This arrangement allows the strap to incline, particularly upwards, so that the strap may be placed behind the top portion of the nape, thereby avoiding any interference with the ear region, and increasing the overall comfort of the mask. As mentioned above, the operation of emptying the mask of all water infiltrated therein is facilitated by the possibility of swinging the mask body with respect to the strap branches.

Still with reference to FIG. 2, the front end portion of the buckle element box 204 has a circular edge, coaxial to the central pushbutton 6, having the shape of an arc of a circle, whereas the snap seat formed by the two walls 103, 203 has, near said end, an accordingly circular profile, coaxial to the central engagement hole 5, so that it may form a guide wall 403 for the swinging front edge of the buckle plate 204. It shall be further noticed that the inner wall 203 extends backwards to a smaller extent as compared with the outer wall 203 and has a circular rear edge 303 against which the front ends of a pair of tabs 404 abut in both opposite upward and downward swinging directions, each tab extending transversely from each of the opposite longitudinal edges of the box 204 of the buckle element into the mask. These tabs 404 also act as snap support means for the swivel member 104, thereby helping to form a housing and shielding structure. But when different types of buckles are provided, for instance having fixed locking means, said tabs may be replaced by two teeth. In practice, the swinging motion of the buckle is restricted in such a manner that the two branches of the strap may be oriented from a substantially horizontal position to an upwardly inclined position, particularly through about 45 degrees. In a simpler embodiment the buckle may be omitted, and the ends of the strap may be directly fastened onto the plate 204, or a simpler buckle may be provided, e.g. provided with fixed strap locking means, and with a front snap extension similar to the one described for the plate 204 and made from one piece with the buckle.

Figure 3:
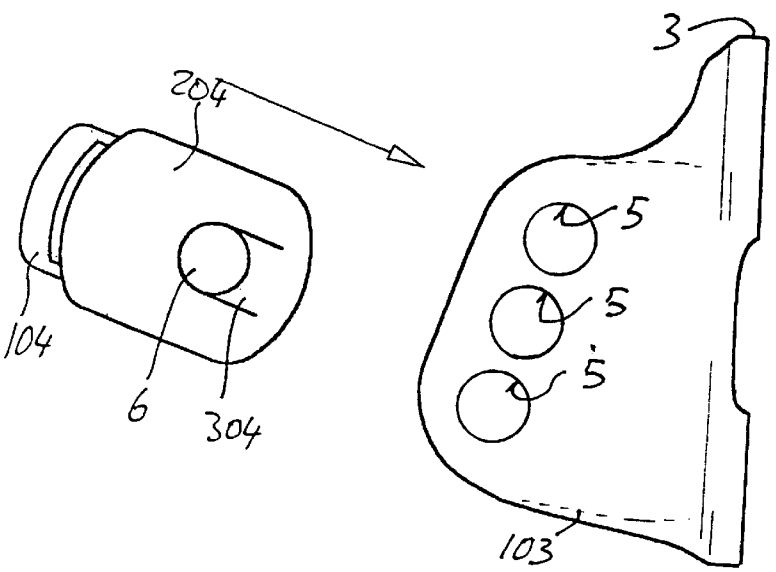
FIG. 3 is a side view of the buckle attachment zone, with the latter not being inserted in its housing, and with reference to a third embodiment of the mask.

Referring now to FIG. 3, in the illustrated embodiment the two walls 103, 203 which form the snap seat for the buckle plate 204 extend upwards, in such a manner as to include a succession of holes having equal diameters and arranged along a substantially vertical axis, for height adjustment of the attachment point of the buckle plate 204. By this arrangement, the mask may be further customized, for instance relative to the anatomic configuration of the face of different users. In this case, the rear edge 303 of the inner wall 203 has a substantially rectilinear profile. The front extension of the tabs 404 defines the degree of upward and/or downward swinging freedom of the buckle plate 204. If required, said tabs 404 might extend forward to such an extent as to prevent the buckle plate 204 from swinging, thereby assisting the button 6 and the hole 5 in their function of locking in position the buckle plate 204.

Figure 5:
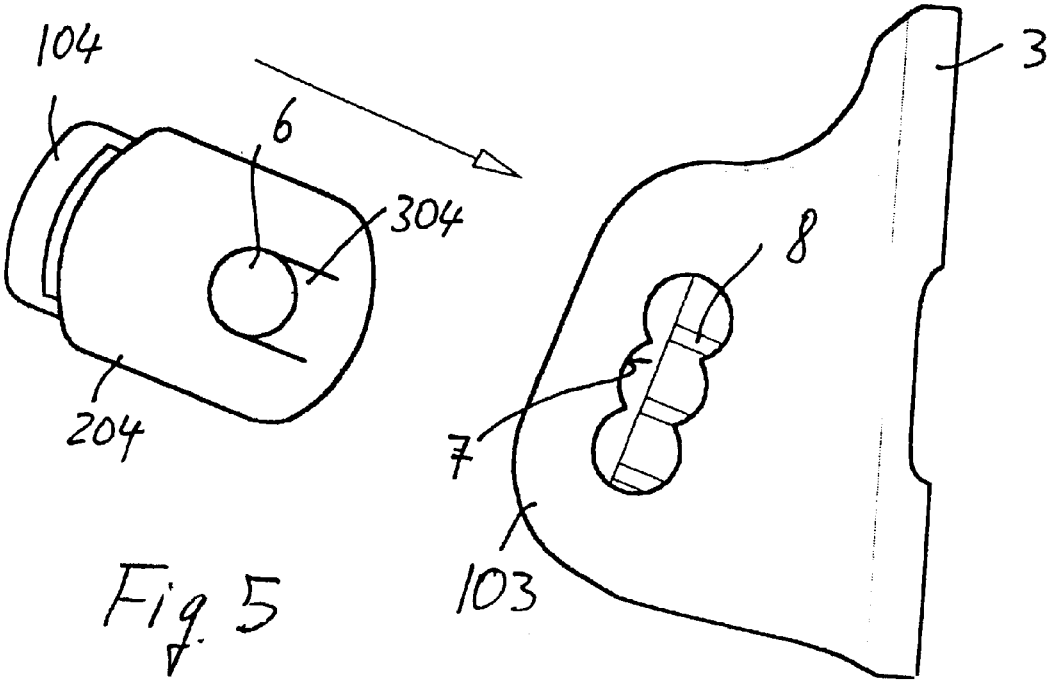
FIG. 5 is the same view as FIG. 3, with reference to a fifth embodiment of the mask according to the invention.

In a different embodiment, as shown in FIG. 5, the holes may be arranged in such a manner as to be partly superposed, to form an elongated slot, wherein the presence of the holes defines a few fixed snap-lock positions for the buckle plate 204.

Figure 4:
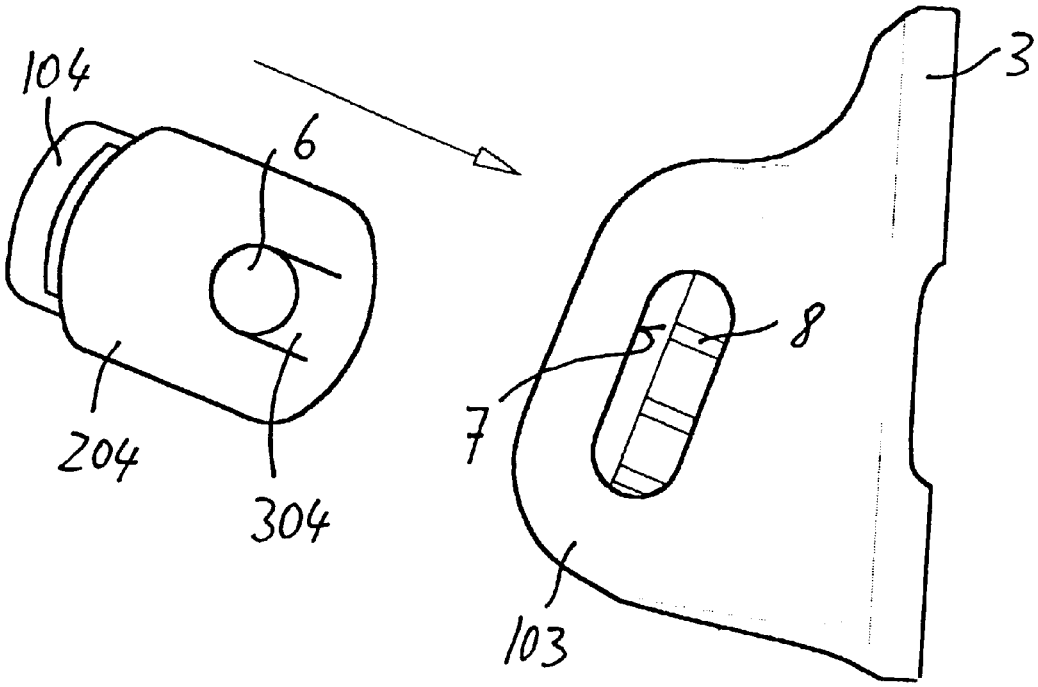
FIG. 4 is the same view as FIG. 3, with reference to a fourth embodiment of the mask according to the invention.
Figure 8:
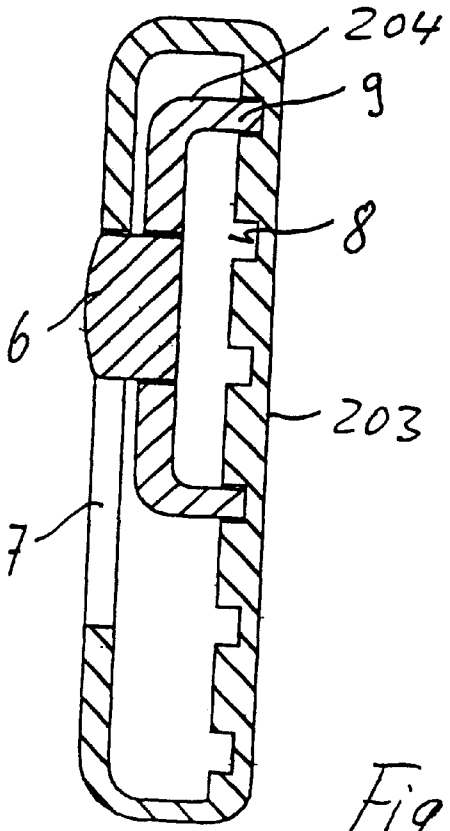
FIG. 8 is a sectional view of the blade as seen through the line DD of FIG. 7C.
Figure 6:
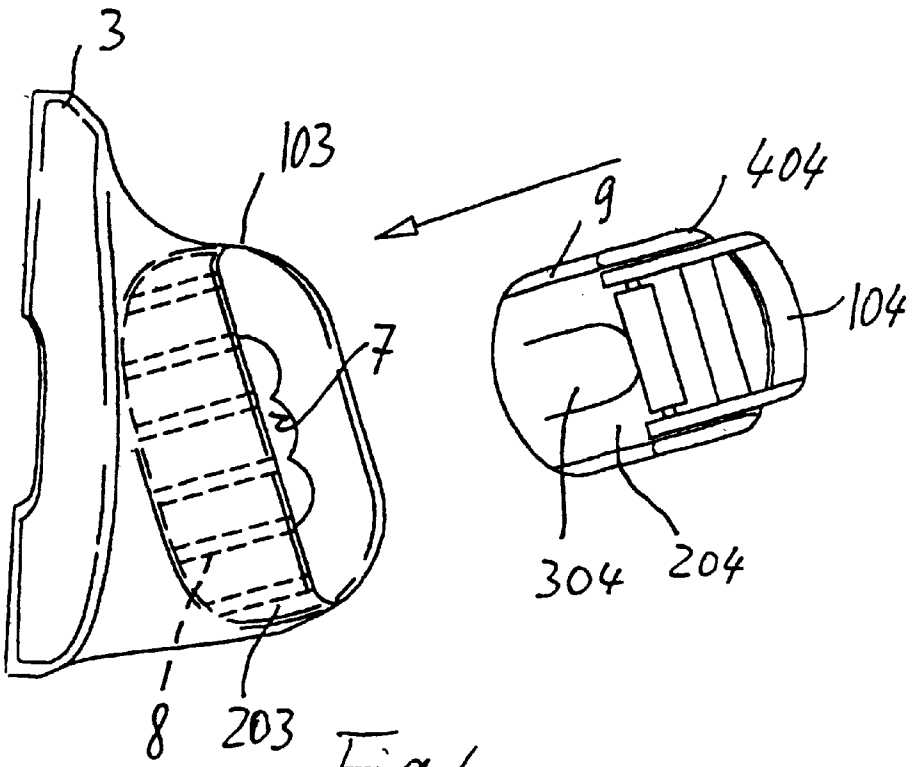
FIGS. 6 and 7A, 7B, 7C are a sectional view of the lens holding frame with reference to a plane perpendicular to the lens (sagittal plane), and a view of the buckle connection zone, in both conditions of insertion (FIG. 6) and non insertion (FIG. 7A, 7B, 7C) in its housing respectively in each of the various possible staggering positions, and with reference to the embodiment of FIG. 5.
Figure 7C:
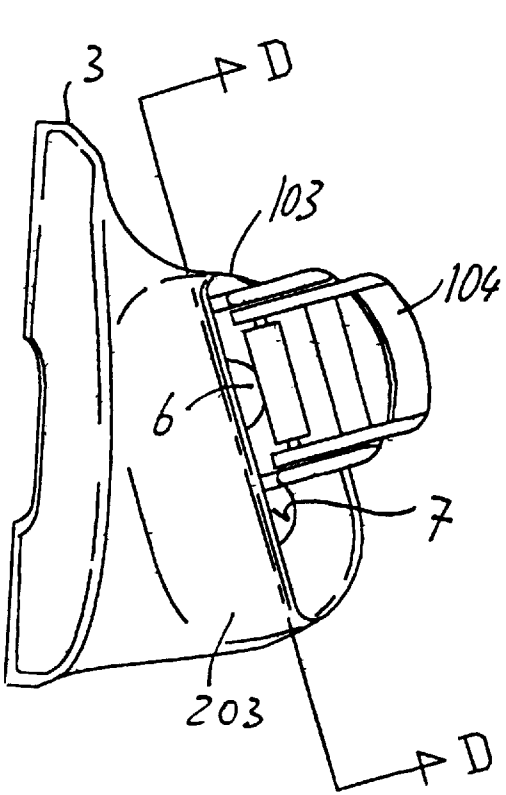
Figure 7B:
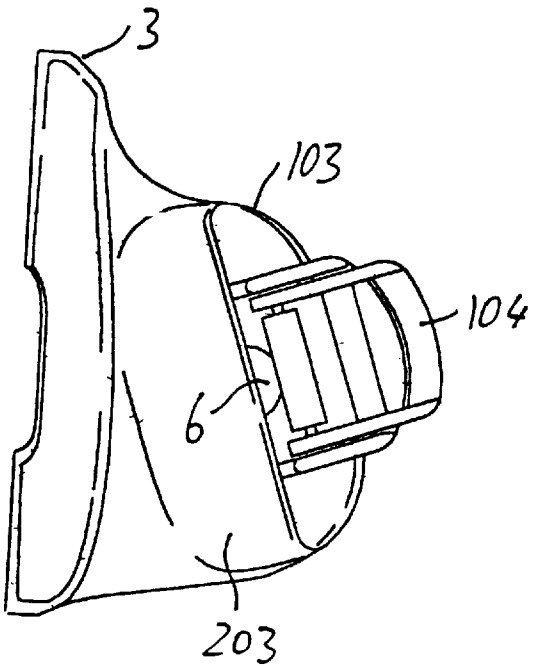
Figure 7A:
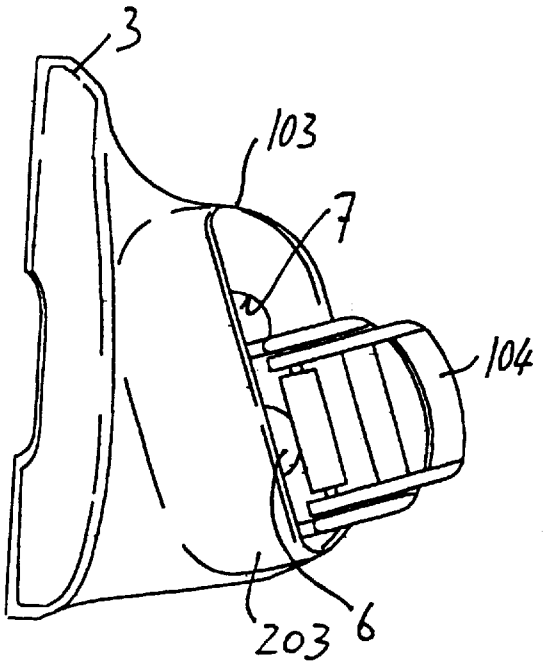
Figure 10:
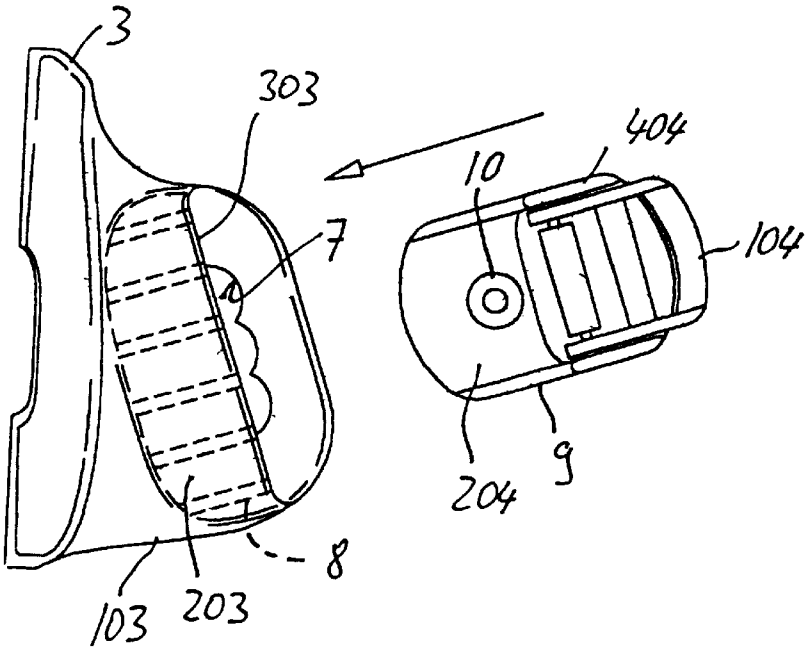
FIGS. 10 and 11 are the same views as FIGS. 6 and 7, with reference to the embodiment of FIG. 9.
Figure 9:
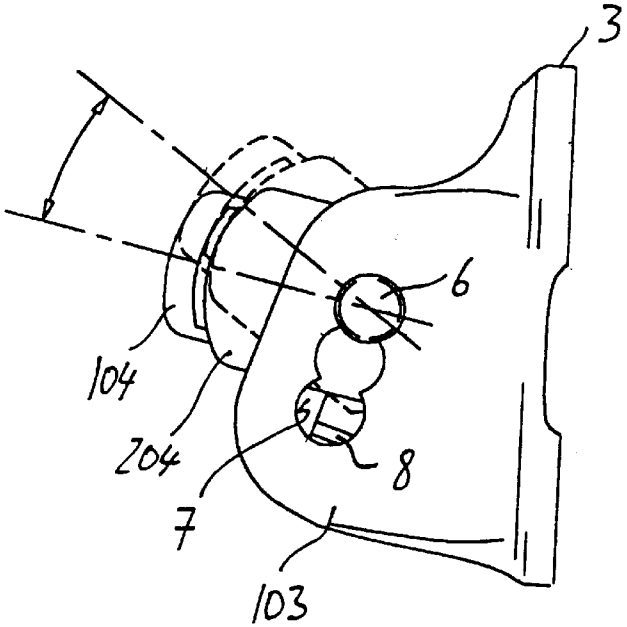
FIG. 9 is the same view as FIG. 3, with the buckle being inserted in its housing, and with reference to a sixth embodiment of the mask according to the invention.

Nevertheless (as shown in FIG. 4), the slot 7 may be arranged to have substantially rectilinear longitudinal edges to allow a continuous change of the downward staggering distance of the attachment point for the buckle plate 204. In this case, the inner face of the inner wall 203 which internally defines the snap seat for the buckle plate has a plurality of slide engagement grooves 8, substantially arranged in the axial direction of the strap, for corresponding tabs 9 disposed along the longitudinal edges of the front portion of the plate 204 and turned inwards. The grooves 8 and the tabs 9, which are spaced in a corresponding manner, act as elements for holding the buckle plate 204 in the various height position, in addition to the holes 5 and/or the slot 7 for snap engagement of the pushbutton 6 of the buckle plate 204. Nevertheless, as is clearly shown in FIG. 8, here the buckle element is height adjustable but may not be swung, as it is held by the combination of grooves 8 and tabs 9. It shall be further noted that, when holes 5 or a slot 7 formed by the partial superposition of holes 5 is provided, the grooves 8 are in a smaller number and in predetermined positions as compared with the embodiment having a continuous slot 7, in which the height of the attachment point for the buckle plate 204 may be adjusted more extensively due to the lack of predetermined height adjustment attachment points. As an alternative thereto or in combination therewith grooves 8 may be provided on the inner face of the outer wall 103 and corresponding tabs 9 may be provided on the outer face of the buckle plate 204. Obviously, the grooves 8 may be also provided instead of the tabs 9 and vice versa.

Figure 12:
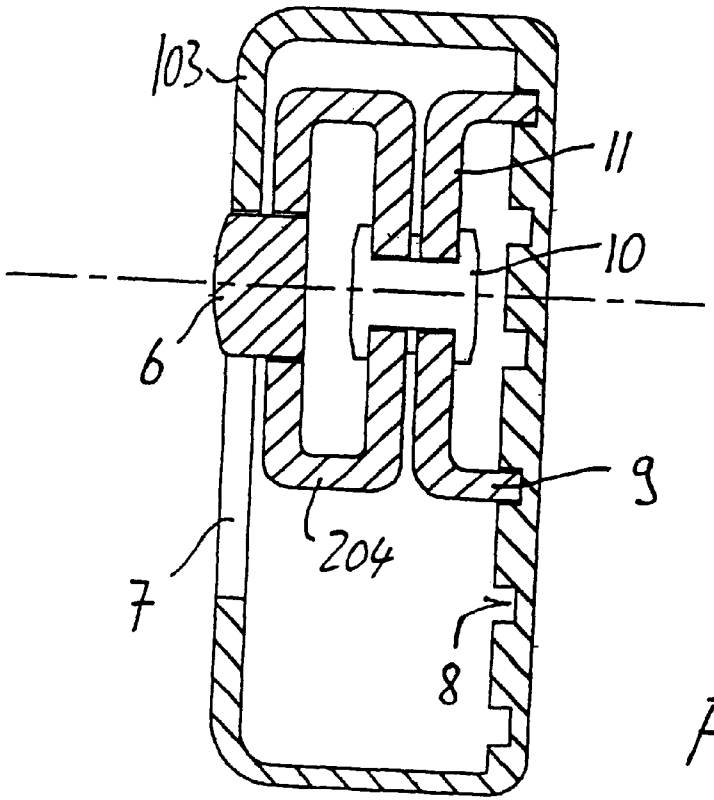
FIG. 12 is a sectional view as seen through the line EE of FIG. 11.
Figure 11:
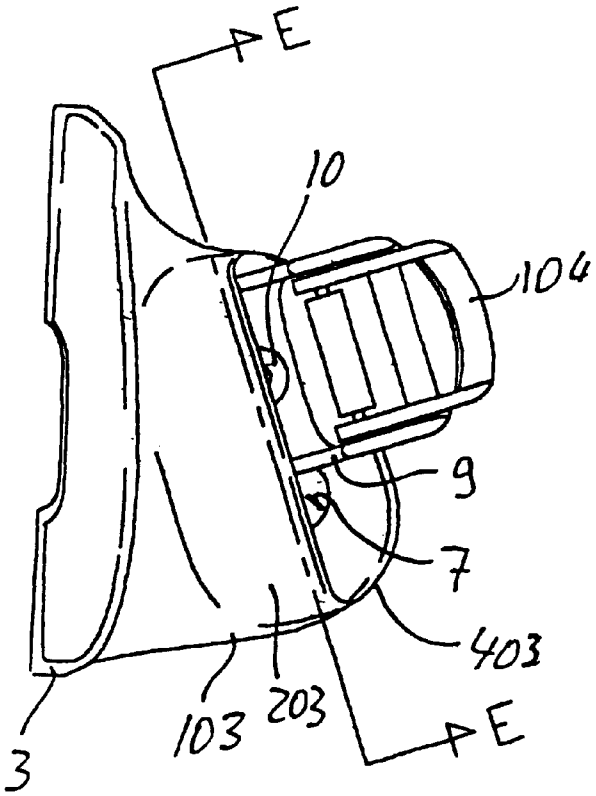

An additional improvement (as shown in FIG. 12) obviates this drawback by providing that the buckle plate is mounted in such a manner as to rotate about a pivot 10, on an additional member 11, in turn having tabs 9 for sliding engagement in the axial direction of the strap in the grooves 8. In practice, the buckle plate 204 is divided into two parts, a base element 11 having a substantially C section, which has a pivot 10 for rotary connection of the actual plate 204 which carries the button 6. In this case the plate 204 is closed at it bottom by an arrangement which prevents any interference with the swivel member 104. The C-shaped element 11 provides a sealing action in the vertical direction because it snaps in the guide grooves 8, but the pivot 10 allows the plate which carries the button 6 to rotate. The pivot 10 and the pushbutton 6 are coaxial to each other, to allow the buckle element to swing to a condition in which its plate is engaged in the snap seat.

In the embodiment of FIGS. 13 to 18 a mask according to invention is shown in which the two opposite buckles and/or the two opposite backward extensions 103 are secured in a removable way to the frame holding the transparent element by means of snap coupling members 20 which are integral with the said buckles and/or the said backward extensions 103 and which are made in such a way as to be replaced one with the other thus modifying the vertical position of the buckles and or the backward extensions 103.

According to this embodiment, each of the two opposite buckles and/or backward extensions 103 are integral with a an associated snap coupling member 20 which cooperates with coupling zones 22 of the frame 3 for holding the transparent element 2. Although in the figures the snap coupling members 20 cooperate with coupling zones 22 at the vertical sides of the mask, i.e. of the frame 3 this does not be interpreted as a limitation, since the snap coupling means may be constructed also in such a way as to cooperate also or exclusively with other parts of the frame such as for example at the angles between the upper and the lower sides of the frame and the said vertical sides.

The buckle and/or the backward extensions 3 may be constructed as described in the previous embodiments of FIGS. 1 to 12. Each snap coupling element is formed as a sleeve which is axially slotted and/or opened and which has a cross section with an angular extension slightly greater than 180°. Each coupling sleeve has an internal cross-section and an internal shape as to fit to the corresponding coupling zone 22 of the vertical sides of the frame 3. Particularly, the two coupling zones are provided symmetrically on the two vertical sides of the frame with reference to a vertical central axis A1 dividing the mask into two halves. Furthermore, the shapes of the two coupling zones 22 on the vertical sides of the frame 3 are symmetrical. As clearly appears from the drawings, the two coupling zones 22 are also symmetrical to a horizontal central axis A2 which is perpendicular to the central vertical axis A1. In other words the position and the shape of the coupling zones 22 is rotationally symmetric with respect to a central point C. The snap coupling elements 20 being correspondingly shaped relative to the inner surfaces of the snap coupling sleeve may be mounted either at the left hand coupling zone 22 or at the right end coupling zone 22 of the frame 3. Each snap coupling member 20 is integral with a buckle and/or with a backward extension 103. The said buckle and/or the said backward extension positioned eccentrically with respect to the said horizontal axis A2, particularly staggered at one of the two ends or projecting out of one of the two ends of the snap coupling sleeve.

Figure 13:
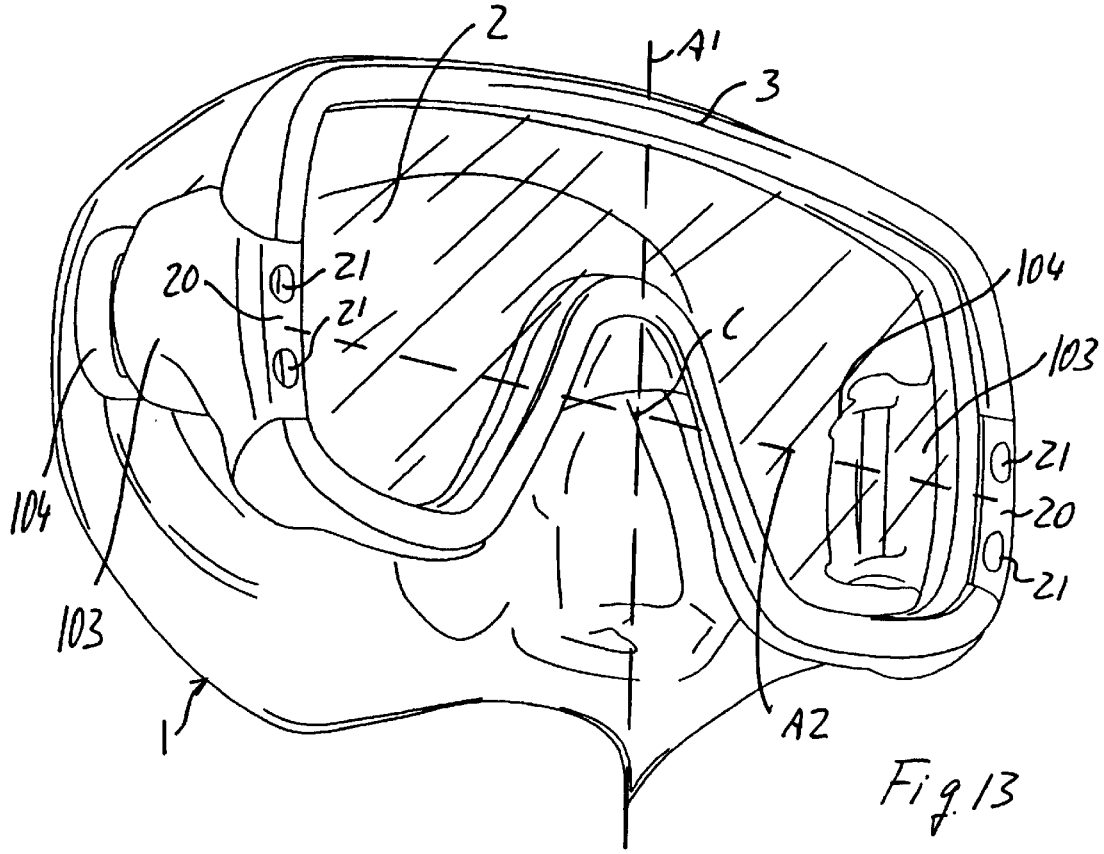
FIGS. 13 and 14 show a perspective view of a mask according to a further embodiment of the invention in which the two opposite buckles and/or the two opposite backward extensions are secured in a removable way to the frame holding the transparent element by means of snap coupling members which are integral with the said buckles and/or the said backward extensions and which are made in such a way as to be replaced one with the other thus modifying the vertical position of the buckles and or the backward extensions.
Figure 14:
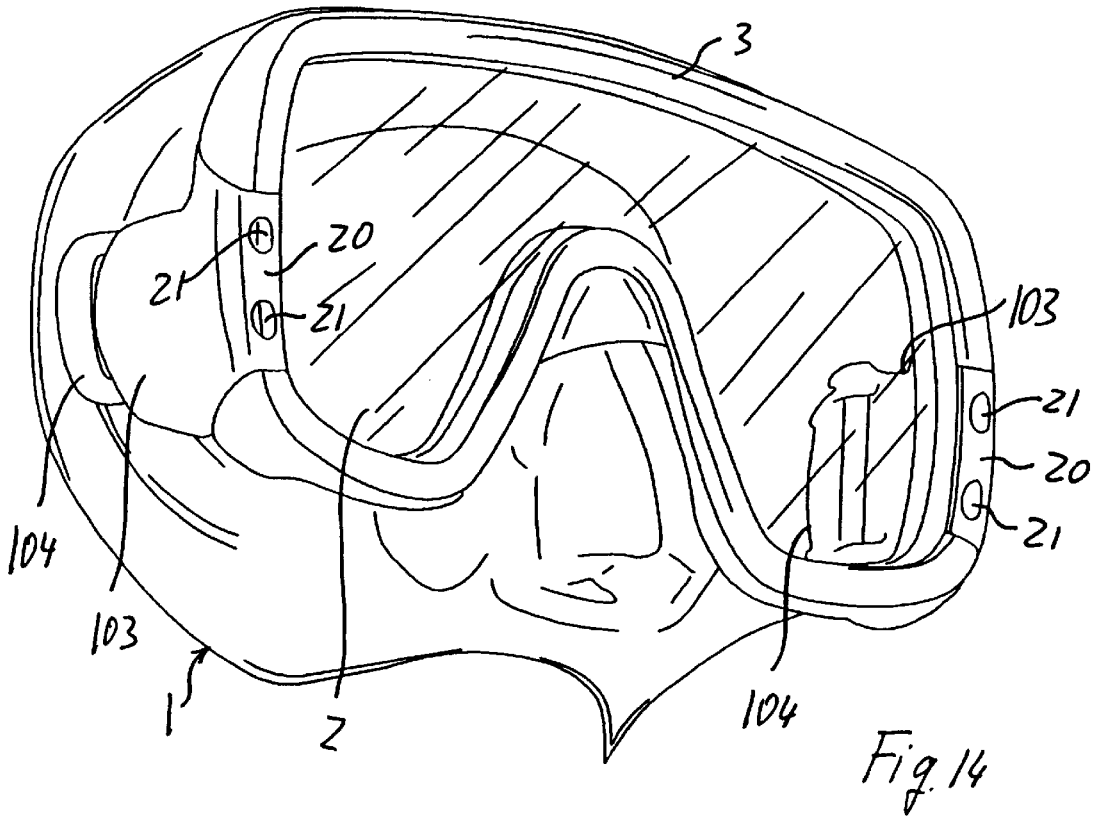
Figure 15:
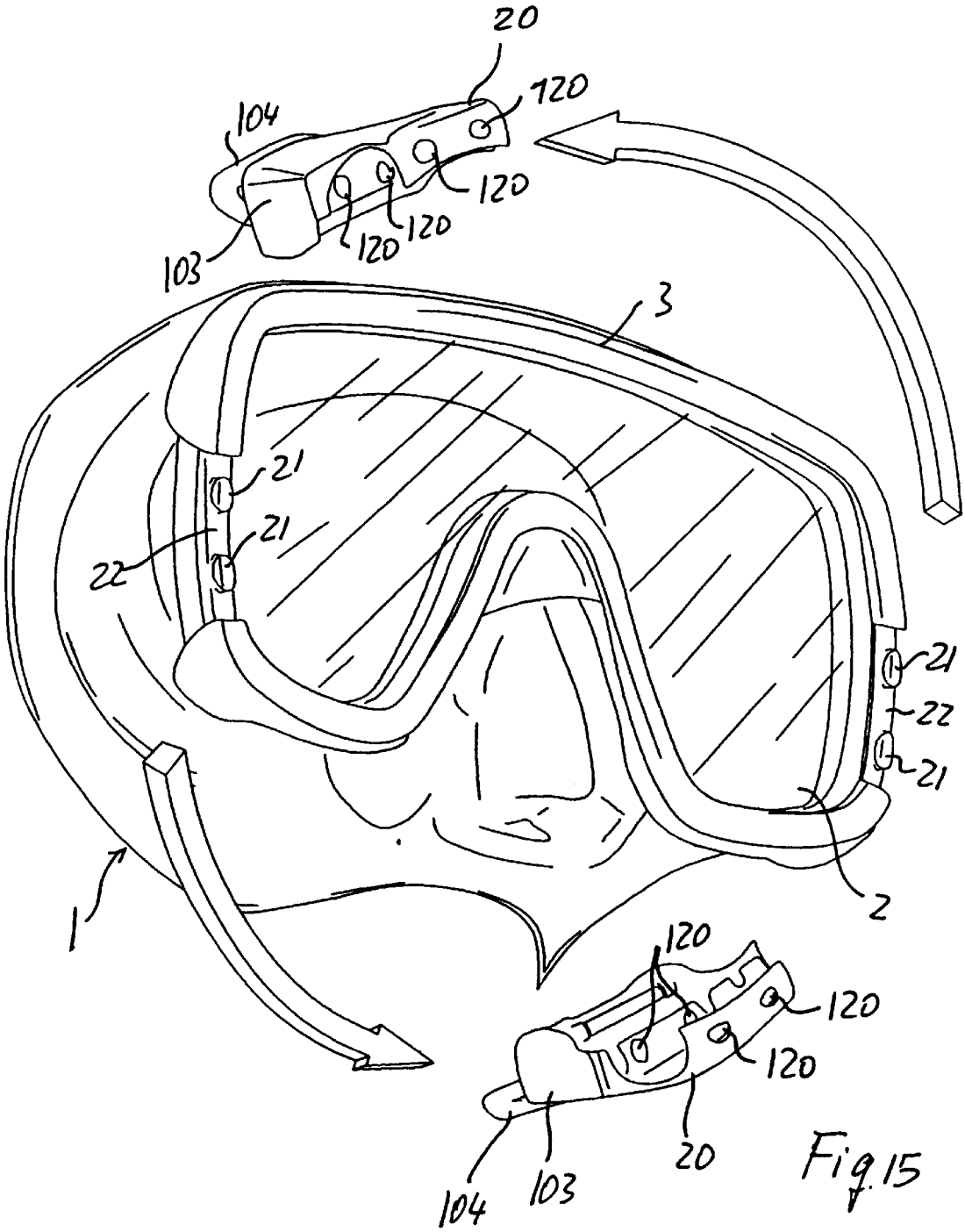
FIG. 15 is a perspective view showing the act of replacing one buckle and/or backward extension with the other according to the further embodiment of FIGS. 13 and 14.
Figure 16:
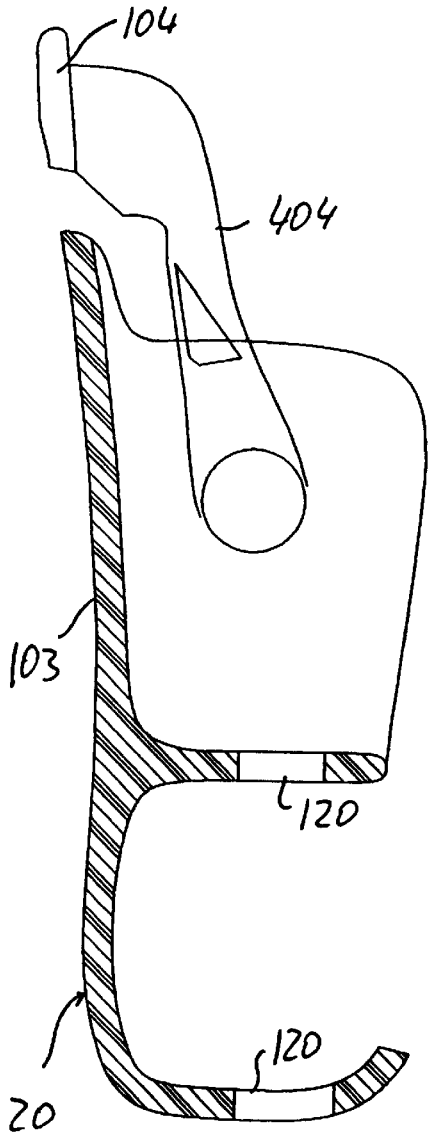
FIG. 16 and FIG. 17 show enlarged cross sectional views respectively of one buckle and/or backward extension integral with the snap coupling element and of the coupling zone of the frame holding the transparent element before coupling.
Figure 17:
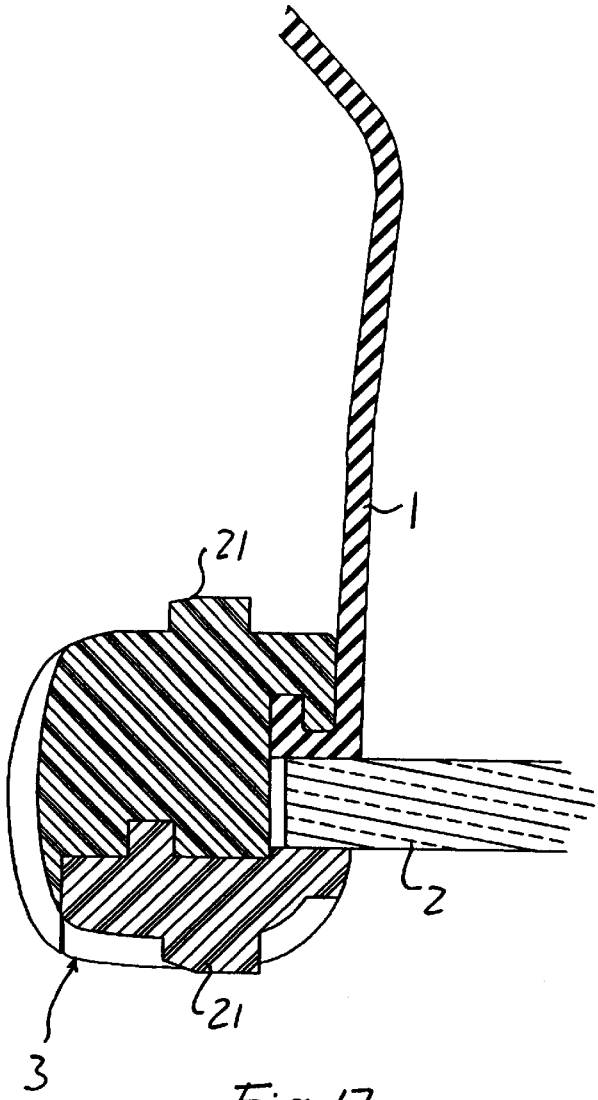
Figure 18:
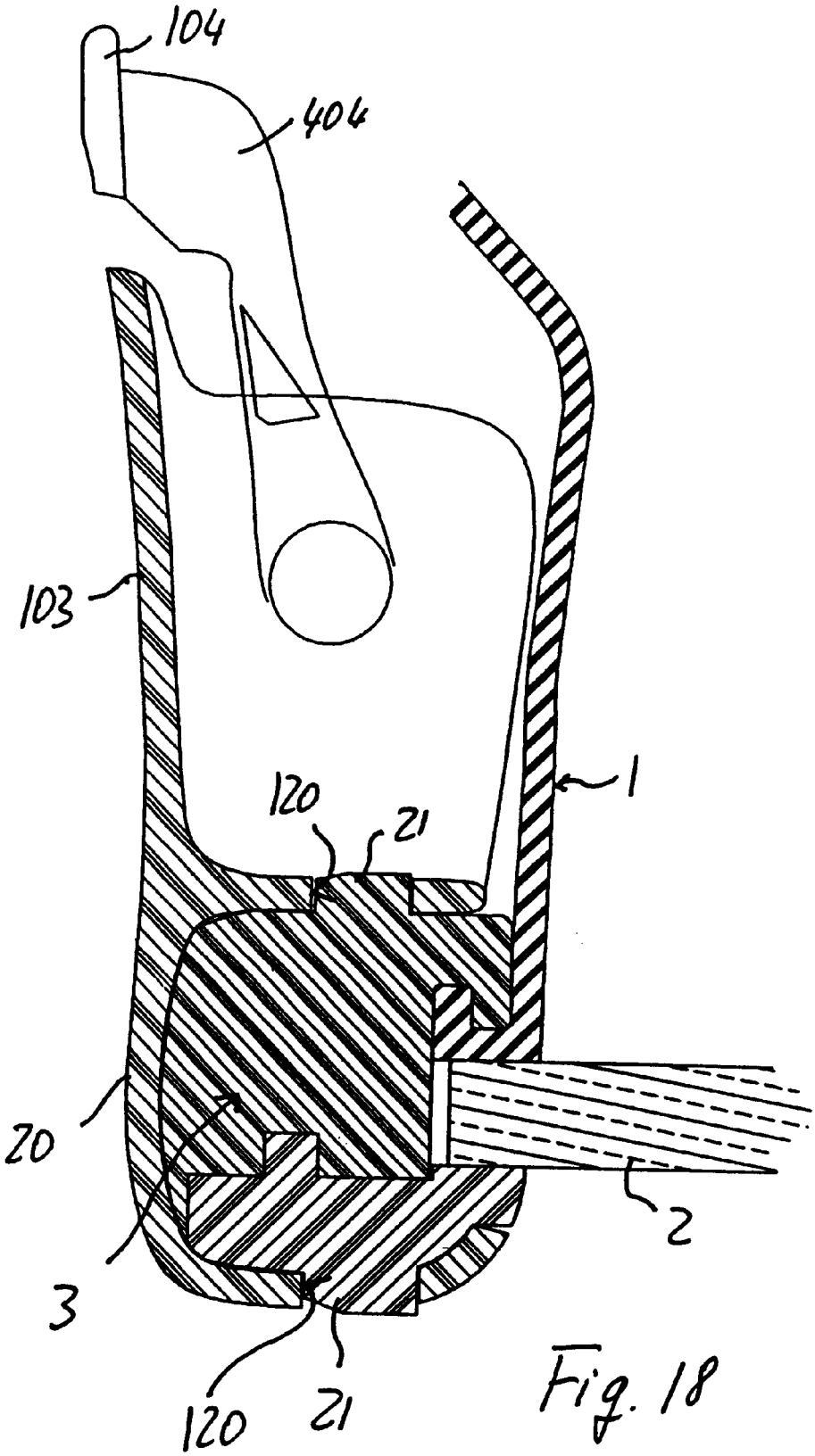
FIG. 18 shows a cross-sectional view similar to the ones of FIGS. 16 and 17 but in which the snap coupling member and the frame are coupled together.

Thus as it can be seen in FIGS. 13 to 15, the buckle element and/or the backward extensions 103 may be mounted on the frame into two positions namely in a centered position with respect to the mask and in a downward staggered position. In the centered position of the buckle and/or of the backward extensions 103 the mask will have a transparent element 2 that will be oriented substantially vertically or perpendicularly to the sight direction or at least less inclined. In the second, downward staggered position of the buckle and/or of the backward extensions, the transparent element will have an inclined position when the mask is worn by the user.

The changing in position of the buckles and/or of the backward extensions 103 and thus of the transparent element 2 may be achieved by simply replacing the right buckle and/or backward extension 103 and the associated snap coupling member 20 with the left one and vice versa. This works due to the above described and particular shape of the coupling zones 22 on the frame and of the snap coupling members 20.

According to further features of the said embodiment, as it might appear from FIGS. 15 to 18, the coupling zones 22 on the frame 3 have a reduced external diameter with respect to the remaining part of the frame. The snap coupling sleeves have an external shape and an external dimension to fit in the recess of the coupling zones 22. Particularly, in the mounted condition, the snap coupling sleeves complete the external shape of the frame at the coupling zones 22 in such a way that the frame shape seems not to be interrupted.

For fastening the coupling of the snap coupling element in the recessed coupling zones 22 of the vertical sides of the frame 3 there are provided at least two radial teeth 21 which have different angular positions and which snap into coincident holes 121 in the snap coupling sleeve 20. Particularly the at least two teeth are diametrically opposite one with respect to the other and cooperate with holes 21 provided into the opposite parts of the sleeves separated by the axial slot. As it appears from the figures there might be four or more teeth placed at each coupling zone 22, each pair of teeth being placed at a different angular position and the teeth of each pair being aligned along the same axial direction. The same concept applies to the holes 21. It is to be noted that the teeth of each axial pair are distributed in order to satisfy the symmetric conditions stated above and which are necessary in order to ensure the replacement of the right hand snap coupling member 20 with the one at the left hand and vice versa. Furthermore, the radial extension of the teeth is such that a free end surface lies on the ideal continuation of the surface of the frame at the coupling zones 22 so that when the snap coupling members are mounted on the frame they complete the shape of the frame itself.

Obviously, the invention is not limited to the embodiments described and illustrated herein, but may be greatly varied, without departure from the guiding principle disclosed above and claimed below.

It shall be further intended that the term mask as used in the foregoing description and in claims denotes a wide concept and is to be considered as comprehensive of scuba diving and/or swimming masks differing from those described and illustrated expressly and also similar objects, particularly like the so-called swimming goggles or the like.

Furthermore the term inclination does not apply to the shape of the transparent element but to its orientation irrespective of whether the transparent element is a plane or slightly curved, although the normal case is to consider a plane surface which might be curved only at the two opposite sides and along an axis which is substantially parallel to the above defined central vertical axis.

What is claimed is:

1. A diving and swimming mask, comprising a mask body made of a soft material which has at least one front opening around the eye region, which opening is closed by a transparent member, and there being provided, at each lateral side of the mask, attachment points for attaching an end of a strap and/or a buckle element for engagement of an end of a strap for fastening the mask against the user's face, wherein when worn by the user the transparent member is positioned inclined against the face of the user at a lower edge of the said transparent member, at the edge nearest to the user's mouth so that the upper edge of the transparent element is nearer to the user's face at the said lower edge, than at an opposite upper edge of the said transparent element.

2. A diving mask according to claim 1, wherein side attachment points are provided for displacing the transparent element in the inclined position.

3. A diving mask according to claim 2, wherein the said side attachment points for displacing the transparent element in the inclined position are formed by the attachment points for attaching the strap and/or the buckle element which are placed in a downward staggered position, so that they are eccentric to and/or at least below an interpupillary line, with reference to a vertical extension of each side of the mask, and with reference to the mask being worn by a standing user.

4. A mask as claimed in claim 1, wherein said attachment points for attaching the strap and/or the buckle element are positioned on each of two vertical side edges of the mask and/or on one or more rigid frames designed to hold the lens against the soft mask body.

5. A mask as claimed in claim 1, wherein the attachment points for attaching the strap and/or the buckle element are secured to the mask in such a manner as to allow displacement thereof in at least one direction to change a vertical stagger extent thereof and thus to change the inclination of the transparent element.

6. A mask as claimed in claim 1, wherein the attachment points for attaching the strap and/or the buckle element are secured to the mask in such a manner as to be able to swing about an axis that is horizontal and/or perpendicular to an extension of the strap in the attachment zone.

7. A mask as claimed in claim 1, wherein said mask body consists of at least one rigid frame which extends all along the peripheral edge of the at least one lens, thereby compressing the at least one rigid frame in a water-tight manner against the edge of the at least one front opening of the soft mask body.

8. A mask as claimed in claim 1, wherein end attachments are provided for attaching each end of the strap or each buckle element to their respective side edges of the frame, which are removable.

9. A mask as claimed in claim 1, wherein side edge oscillators are provided which allow oscillation with respect to the side edge of the mask whereto each end of the strap or each buckle element are attached, particularly about an axis which is substantially horizontal and perpendicular to the side edge of the holding frame, and to the extension of the strap in that zone.

10. A mask as claimed in claim 1, wherein height adjustors are provided for adjusting the height of an attachment point for each end of the strap or each buckle element on their respective side edges of the frame.

11. A mask as claimed in claim 1, wherein the mask includes at least one backward extension of each vertical side edge of the frame for holding the lens against the mask body, on each vertical side edge, with reference to the observation direction of the mask user, and that each of these backward extensions forms a housing for a buckle element, which buckle may include strap locking of the stationary or tilting type, which provide an automatically release of the strap in the loosening and/or stretching direction upon activating a pushbutton.

12. A mask as claimed in claim 1, wherein each of these backward extensions is placed in a downward staggered position with reference to a vertical extension of the side edge of the frame for holding the lens against the mask body, and with reference to the mask as worn by a standing user.

13. A mask as claimed in claim 1, wherein at least one or both buckle elements are secured in a non removable manner on backward extensions.

14. A mask as claimed in claim 1, wherein at least one, buckle element may be coupled in a non removable manner on backward extensions, by snap-locks.

15. A mask as claimed in claim 1, wherein backward extensions of the frame are composed of two substantially vertical and parallel walls, extending backwards from each side edge of the frame, in such a manner as to form a recess or a pocket open at the rear, which acts as a snap seat for a buckle plate, the thickness of said plate being slightly smaller than the distance between the two walls.

16. A mask as claimed in claim 1, wherein an outer wall and/or an inner wall of a snap seat have one or more snap engagement holes or apertures for a corresponding number of coupling/uncoupling members having a complementary shape and being disposed on an outer and/or inner surface of a buckle plate.

17. A mask as claimed in claim 1, wherein an outer wall of a snap seat has a substantially central hole or aperture for snap engagement/disengagement of a corresponding coupling/uncoupling member which is placed substantially at the center of an outer face of a buckle plate.

18. A mask as claimed in claim 1, wherein said coupling/uncoupling member is placed on an end of a resilient tab, formed by notching the material of the buckle plate, and is formed by a widened portion of said end on a side turned toward the outside of the mask.

19. A mask as claimed in claim 1, wherein said coupling/uncoupling member has an outer surface slightly larger than the surface of a finger end, in such a manner that said coupling/uncoupling member may form a pushbutton, to be easily accessible from the outside for quick coupling/uncoupling of the buckle.

20. A mask as claimed in claim 1, wherein each buckle element is fastened to its respective backward extension of the frame in such a manner as to be able to swing about an axis which is substantially horizontal and perpendicular to a side edge of the holding frame or to an extension of the strap in that zone.

21. A mask as claimed in claim 1, wherein a coupling/uncoupling button, as well as an engagement hole therefore, have a correspondingly circular shape, whereby they simultaneously act as snap locks for the buckle plate in its snap seat, and as side end oscillators for allowing the buckle element to swing, as a pivot or hub.

22. A mask as claimed in claim 1, wherein a front end portion of a buckle element box has a circular edge, coaxial to a central pushbutton, whereas a snap-lock recess formed by two walls has, near said end, an accordingly circular profile, coaxial to a central engagement hole, so that the snap-lock recess may form a guide wall for a swinging buckle plate.

23. A mask as claimed in claim 1, wherein swing limiters are provided for limiting a swinging stroke of the buckle element, particularly such that two branches of the strap may be oriented from a substantially horizontal position to an upwardly inclined position, through about 45 degrees.

24. A mask as claimed in claim 1, wherein swing limiters consist of two teeth or tabs, each extending transversely from each of two opposite longitudinal edges of a buckle plate inwards and/or out of the mask, which teeth or tabs abut at the end of a swinging stroke against a rear edge of an inner wall and/or of an outer wall of a snap seat for the buckle plate.

25. A mask as claimed in claim 1, wherein an outer wall of a snap seat for each buckle plate has two or more holes, having the same diameter, for a pushbutton to snap therein, so that an attachment point for the buckle element may be changed.

26. A mask as claimed in claim 1, wherein said holes are arranged along a substantially vertical axis, to allow height adjustment of an attachment point for a buckle plate.

27. A mask as claimed in claim 1, wherein said outer wall of a snap seat has an elongated slot for engagement of a pushbutton, which extends in a substantially vertical direction, to allow height adjustment of an attachment point for a buckle plate.

28. A mask as claimed in claim 1, wherein said slot may be composed of a succession of partly overlapping holes, such that the difference between the centers of two adjacent holes is smaller than the diameter thereof.

29. A mask as claimed in claim 1, wherein an inner face of an inner wall and/or of an outer wall, which define a snap seat for a buckle plate has grooves for sliding engagement, substantially in the axial direction of the strap, of corresponding tabs or ribs arranged on the inner and/or outer faces of the buckle plate, or vice versa, in such a position as to form buckle plate guides for holding the various height positions of said plate in addition to the holes and/or to a slot for snap engagement of a pushbutton of the buckle plate.

30. A mask as claimed in claim 1, wherein a buckle plate, whose outward face includes a pushbutton, is mounted in such a manner as to be able to rotate about a pivot placed on an opposite inner face, on another element having tabs or ribs for axial slide engagement of the strap, in corresponding grooves formed on the face that defines the snap seat internally and/or externally.

31. A mask as claimed in claim 1, wherein a pivot and a pushbutton are coaxial to each other, to allow the buckle element to swing to a condition in which its plate is engaged in the snap seat.

32. A mask as claimed in claim 1, wherein the buckle element includes a lock that cooperates with the strap, which is a swivel frame, fitted in a plate member which forms the body of the separate buckle.

33. A mask as claimed in claim 1, wherein the attachment points for attaching the strap to the mask may be downwardly staggered to such an extent as to partly project beyond the lower edge of the corresponding lateral side of the mask.

34. A mask as claimed in claim 1, wherein said attachment points are secured over at least a portion of their extension, to a lower extension of said side of the mask.

35. A mask as claimed in claim 1, wherein the extension for snap coupling or housing a buckle swivel not only extends in the backward direction with respect to the transparent element, but also extends downwards beyond the lower edge of the frame for holding the transparent element against the mask body.

36. A mask according to claim 1, wherein the each of the two buckle elements and/or of two backward extensions for holding the said buckle elements are secured to an associated snap coupling member which is removably coupled to the vertical side edges of the mask and/or of the side attachment points for holding the transparent member, the said buckle and/or the said backward extension being secured to the snap coupling member in such a way as to be downwardly staggered in the mounted condition on the mask and/or on the side attachment points for holding the transparent member.

37. A mask according to claim 36, wherein the two opposite buckles and/or the two opposite backward extensions are secured in a removable way to the frame holding the transparent element by snap coupling members which are integral with the said buckles and/or the said backward extensions and which are made in such a way as to be replaced one with the other thus modifying the vertical position of the buckles and or the backward extensions.

38. A mask according to claim 36, wherein the snap coupling members of the two buckle elements and/or of the two backward extensions has identical snap coupling members to the frame for holding the transparent element the said snap coupling members being rotationally symmetrical with reference to a center of the said frame for holding the transparent element as well as the coupling zones of the said frame for holding the transparent element which cooperate with the said snap coupling members so that the said two snap coupling members may be secured indifferently to one or the other of the two opposite sides of the frame holding the transparent element.

39. A mask according to claim 36, wherein the snap coupling member for each of the two buckle elements and/or of each of the two backward extensions cooperate each one with a corresponding vertical edge of the frame for holding the transparent member at coupling zones of the said vertical edges which are symmetrically positioned with respect of the central axis of the mask, which axis is vertical in the upright position of a user wearing the mask, the said vertical edges being symmetrically shaped with reference to the said central vertical axis at least at the coupling zones and with reference to a horizontal central axis of the said coupling zones which is perpendicular to the said vertical central axis of the mask, while each coupling member of each of the two buckle elements and/or each of the two backward extensions are also symmetrical relatively to the said two axis and may couple indifferently with one of the two coupling zones on the two vertical edges of the frame for holding the transparent member, the said buckle elements and/or the said backward extensions being placed eccentrically with respect to the said horizontal axis on their snap coupling member so that the buckle elements and/or the backward extensions may be positioned alternatively in a centered position on the vertical side edges of the frame for holding the transparent element in which the said transparent element is not inclined or is less inclined and in a downward staggered position in which the said transparent element is inclined or more inclined by simply replacing the buckle element and/or backward extension with the associated snap coupling member on the left hand with the one on the right end and vice versa.

40. A mask according to claim 36, wherein the side attachment points for holding the transparent element are formed by a frame having a rounded cross section and the snap coupling members are formed by longitudinally slotted or opened sleeves having an internal shape corresponding to that of the coupling zones at the holding frame of the transparent member, which slotted or opened sleeve has a cross section with an angular extension which is at least slightly greater than 180°.

41. A mask according to claim 40, wherein the coupling zones on the frame holding the transparent element have a reduced cross section and the snap coupling slotted sleeves has such a shape and such an outer diameter that they complete the frame shape at the coupling zones in a smoothed manner ad/or in a continuous manner.

42. A mask according to claim 40, wherein at the coupling zones of the frame holding the transparent element at least one radial tooth is provided coinciding with an opening of the corresponding snap coupling sleeve.

43. A mask according to claim 42, wherein at least two teeth are provided at each coupling zone which teeth are positioned at different angular positions each one cooperating with a coincident opening on one of the two opposite parts of the snap coupling sleeve separated by the opening or the slot.

44. A mask according to claim 1, wherein the transparent element is plane or curved at the opposite ends around axis which are substantially parallel to the vertical central axis.

* * * * *

UNITED STATES PATENT AND TRADEMARK OFFICE

CERTIFICATE OF CORRECTION

PATENT NO. : 6,708,349 B2
DATED : March 23, 2004
INVENTOR(S) : Roberto Semeia

It is certified that error appears in the above-identified patent and that said Letters Patent is hereby corrected as shown below:

Title page,
Item [30], Foreign Application Priority Data, should read:

-- Sep. 24, 2001 (IT) ..... SV2001A000031 --

Signed and Sealed this

Nineteenth Day of October, 2004

JON W. DUDAS
*Director of the United States Patent and Trademark Office*